United States Patent [19]

Seifert

[11] Patent Number: 5,017,172

[45] Date of Patent: May 21, 1991

[54] CONVERTIBLE YO-YO AND TOP

[76] Inventor: C. Vaughn Seifert, 300 Flag Hill Rd., Boxboro, Mass. 01719

[21] Appl. No.: 464,926

[22] Filed: Jan. 16, 1990

[51] Int. Cl.[5] ..... A63H 1/30; A63H 1/08; A63H 1/06

[52] U.S. Cl. ..... 446/250; 446/263; 446/259

[58] Field of Search ..... 446/250, 236, 245, 243, 446/247, 248, 251, 252, 255, 256, 259, 261, 262, 263, 264

[56] References Cited

U.S. PATENT DOCUMENTS

| | | | |
|---|---|---|---|
| 1,291,752 | 1/1919 | Breyer | 446/262 |
| 2,579,022 | 12/1951 | Spencer et al. | 446/250 |
| 2,794,294 | 6/1957 | Frangos | 446/250 X |
| 2,891,351 | 6/1959 | Madaras et al. | 446/250 |
| 3,175,326 | 1/1963 | Isaacson | 446/250 |
| 3,256,635 | 11/1962 | Radovan | 446/251 |
| 3,408,766 | 11/1968 | Ajero | 446/255 |
| 3,413,753 | 12/1968 | Colmer, Jr. | 446/250 |
| 3,936,974 | 2/1976 | House | 446/250 |
| 4,207,701 | 6/1980 | Kuhn | 446/250 |
| 4,332,102 | 6/1982 | Caffrey | 446/250 |
| 4,895,547 | 1/1990 | Amaral | 446/250 |

FOREIGN PATENT DOCUMENTS

| | | | |
|---|---|---|---|
| 701561 | 1/1965 | Canada | 446/264 |
| 854923 | 11/1970 | Canada | 446/250 |
| 951515 | 7/1974 | Canada | 446/255 |

*Primary Examiner*—Robert A. Hafer
*Assistant Examiner*—D. Neal Muir
*Attorney, Agent, or Firm*—Wolf, Greenfield & Sacks

[57] ABSTRACT

A yo-yo is provided with a construction by which it may be converted easily and quickly to a high performance surface spinning top. After detaching Zone of the yo-yo halves from the axle of the yo-yo, one of the yo-yo halves from the axle of the yo-yo, a spindle is attached to the center of the detached yo-yo half. Means are provided for defining a nib at the opposite face of the detached yo-yo half. The yo-yo string, which will have been removed from the axle may be used as a pull string to be wrapped around the spindle to impart acceleration to the top. The other part of the yo-yo including the other half and the axle are rotatably and telescopically engageable with the end of the spindle to stabilize the position and attitude of the top while it is accelerated. After acceleration, the stabilizer is easily withdrawn thus leaving the top to spin free on supporting surface.

18 Claims, 4 Drawing Sheets

CONVERTIBLE YO-YO AND TOP

FIELD OF THE INVENTION

This invention relates to spinning toys, particularly yo-yos and tops.

BACKGROUND OF THE INVENTION

U.S. Pat. Application Ser. No. 303,648 filed Jan. 27, 1989 describes a high performance yo-yo. It is among the objects of the present invention to increase the versatility of such a yo-yo so that it is quickly and easily convertible into a high performance free spinning surface top.

SUMMARY OF THE INVENTION

The convertible toy of the present invention has two yo-yo halves that are detachably connected by an axle. The axle is securely attached at one of its ends to one of the yo-yo halves. The other yo-yo half is detachably threaded to the other end of the axle by a threaded insert embedded in the detachable yo-yo half. When used as a yo-yo, with the yo-yo halves connected, a low friction cylindrical spool is mounted for free rotation on the axle, between the halves and a string is attached securely to the spool. When the yo-yo spins, its axle rotates within the low friction spool which acts as a bearing. By constructing the spool to have axial movement limited to certain critical values and by controlling critically the space between the yo-yo halves, a high performance yo-yo is achieved which can be made to spin for unusually long times yet which may be returned easily with a simple flick of the wrist.

In order to convert the yo-yo to use as a free spinning surface top, a separate conversion spindle is provided. The spindle is intended to be attached to the first half of the yo-yo after the first half is detached from the axle. The spindle has a threaded end that screws into the threaded insert of the detachable first half of the yo-yo. The tip of the threaded end of the spindle is formed to define a smoothly rounded nib which projects through and slightly out of an axial hole formed in the first yo-yo half. The first yo-yo half and attached spindle define a freely spinnable surface top in which the projecting nib of the spindle serves as the tip on which the top spins. The other end of the spindle is provided with a socket which rotatably receives the yo-yo axle that remains attached to the second half of the yo-yo.

In order to use the yo-yo as a freely spinning top, the first half of the yo-yo is unscrewed from the yo-yo axle. The spool and attached string are removed from the axle. The spindle then is screwed into the second yo-yo half with its nib projecting out of the central hole in the outer face of the first yo-yo half. The yo-yo string then is wrapped about the spindle. The free end of the yo-yo axle which remains attached to the second yo-yo half (and together define a stabilizer assembly) is inserted into the socket in the end of the spindle. The top then may be placed on a smooth surface while holding it in position by holding the second yo-yo half with one hand. The other hand is used to pull on the string to spin the top while the top is maintained in place by engagement of the fixed axle with the spindle. Once the top is spinning, the axle is removed from the socket and the spindle, thus permitting the top to spin and precess freely. The device may be reconverted quickly and easily to a yo-yo configuration by unscrewing the spindle from the second yo-yo half, replacing the spool on the axle and then screwing the threaded end of the axle into the first yo-yo half.

It is among the general objects of the invention to provide a yo-yo that is convertible to a freely spinnable surface top.

Another object of the invention is to provide a convertible yo-yo and top, both of which display high performance and long spinning times.

Another object of the invention is to provide a convertible yo-yo and top which are easily and quickly converted from one configuration to the other.

Another object of the invention is to provide a versatile amusement toy that is of simple low cost construction.

DESCRIPTION OF THE DRAWINGS

The foregoing and other objects and features of the invention will be appreciated more fully from the following further description thereof with reference to the accompanying drawings wherein.

DESCRIPTION OF THE PREFERRED EMBODIMENT

Figure 2:
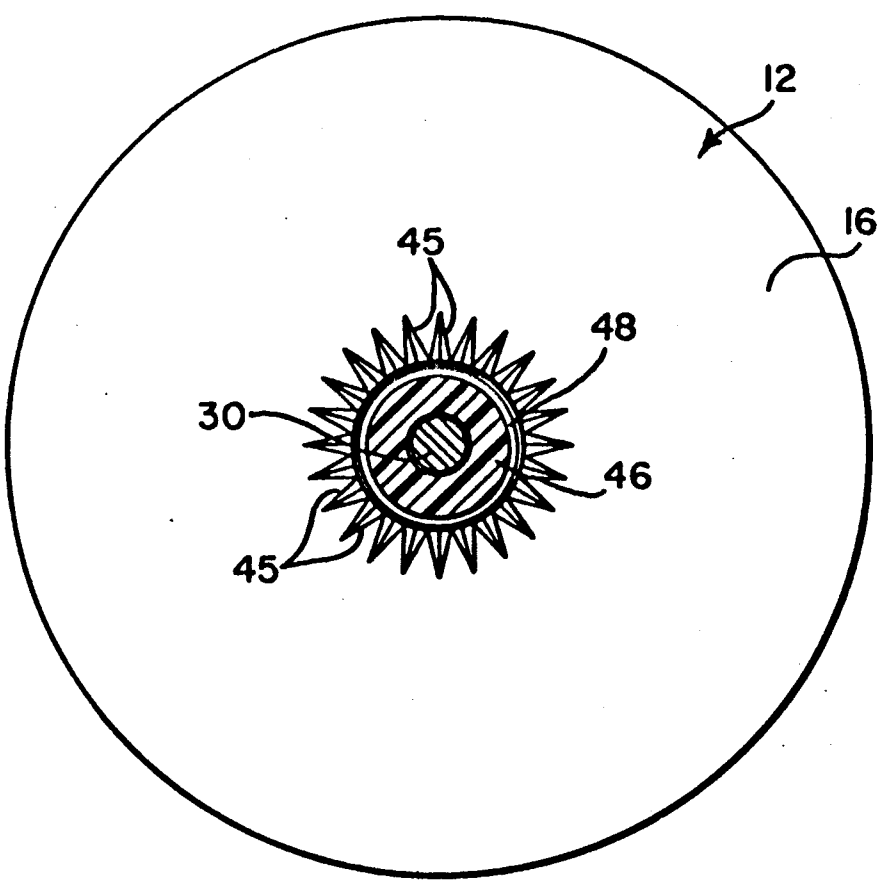
FIG. 2 is an illustration of the internal face of the yo-yo as seen along the plane 2—2 of FIG. 1.
Figure 1:
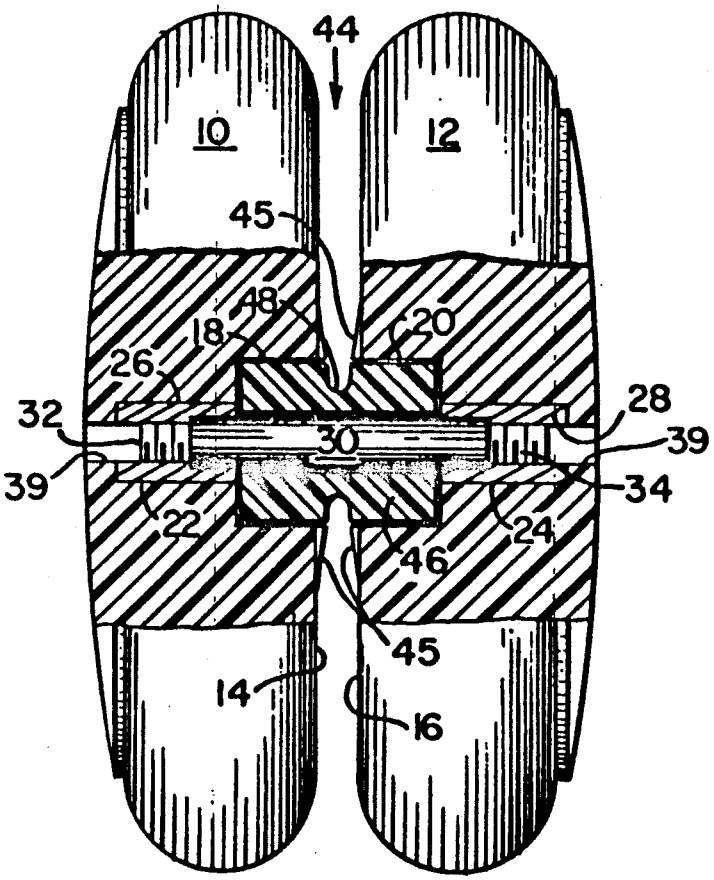
FIG. 1 is a sectional illustration taken through the diameter of the yo-yo.
Figure 3:
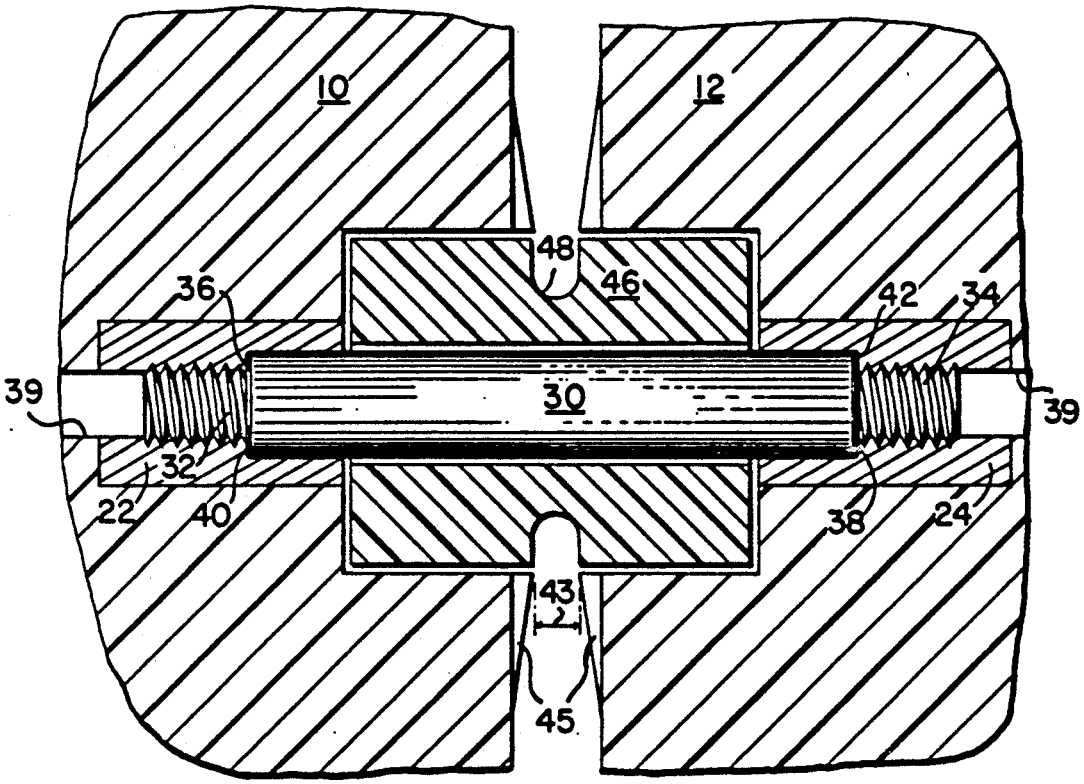
FIG. 3 is an enlarged diametral section through the region of the spool and axle of the yo-yo.

As shown in the drawings, the yo-yo includes a pair of yo-yo halves including a first half 10 and a second half 12. The halves 10, 12 preferably are formed from injection molded plastic, although they may be formed from other materials such as wood, metal or a combination thereof. The yo-yo halves may be about 2 ¼" diameter. The inwardly facing surfaces 14, 16 of the yo-yo halves 10, 12 are provided with cylindrical sockets 18, 20 which, in turn, are formed with internal bores 22, 24. The sockets 18, 20 and internal bores 22, 24 are aligned along the axis of rotation of the yo-yo. Threaded inserts 26, 28, preferably of the type commercially available under the trade designation HeliCoil are embedded in the internal bores 22, 24, respectively. An axle 30, which may be formed from steel rod, having threaded ends 32, 34 is screwed into the threaded inserts 26, 28 as shown in FIGS. 1 and 3. The juncture of the unthreaded portion of the axle 30 with the threaded ends 32, 34 defines shoulders 36, 38 (see FIG. 3) which abut facing shoulders 40, 42 formed on the threaded inserts 26, 28. In the illustrative embodiment, one of the inserts, such as insert 26 on the first half 10, is open at its outer end and communicates with a central bore 39 in the first yo-yo half 10, for a purpose described below.

The inwardly facing surfaces 14, 16 of the yo-yo halves may be provided with an arrangement of radially extending raised ribs 45 surrounding the sockets 18, 20 in somewhat of a starburst pattern. The ribs may be of the order of 0.125" long and may extend above the associated surfaces 14, 16 about 0.010". The ribs enhance the ability of the yo-yo to engage the string when retrieving the yo-yo. As described in detail in U.S. Pat. Application Ser. No. 303,648 filed Jan. 27, 1989 and entitled Superior Performance Yo-Yo, if it is desired for the convertible yo-yo/top to display superior spinning performance when used as a yo-yo, the space 44 between the yo-yo halves 10, 12 adjacent the spool is critical. Under those circumstances, it is important to assure that the threaded inserts 26, 28 are precisely located in the yo-yo halves 10, 12. Where the yo-yo halves 10, 12 are formed from injection molded plastic, it is possible to locate the inserts 26, 28 with such precision using conventional insert molding techniques.

The yo-yo includes a generally cylindrical spool 46 rotatably mounted on the axle 30, the ends of the spool 46 being received, symmetrically, within the sockets 18, 20 of the yo-yo halves 10, 12. By way of example, the axle may be of the order of 0.156" diameter. The inner diameter of the spool 46 being about 0.005" to 0.008" in diameter larger than the axle. The spool 46 preferably is provided with a circumferential groove 48 about which the yo-yo string 49 may be fastened. The yo-yo is intended to be used with standard yo-yo strings commercially available from Lockport Assembly Company of Lockport, N.Y. Preferably the string is fastened in a double loop so that the spool 46 will not rotate with respect to the string. The spool 46 is formed from a polymeric material having good lubricity properties For example, Delrin available from Du Pont has been found to be a suitable plastic. The polymeric material also should be machined to precise tolerances. Other plastics having good lubricity and machinability properties may be employed The outer diameter of the spool 46 is slightly less than the diameter of the sockets 18, 20 so that when the yo-yo is suspended from its string, the yo-yo halves 10, 12 may spin freely without interference with the circumference of the spool. The axle 30 may be coated with a light film of lubricant further to enhance the low frictional characteristics of the device.

In order that the toy, when used as a yo-yo may display superior long duration spinning, it is critical that the axial play of the spool 46 on the shaft (the difference between spool length and distance between ends of sockets 18, 20) be no greater than about 0.018" and preferably about 0.015". The clearance may be as low as about 0.001". As long as the axial play is maintained within those limits, the device will display superior spinning for long times. Also critical to the performance of the yo-yo is the facility with which the yo-yo may be returned to the user from a sleeping configuration with a simple flick of the wrist. By maintaining the space 43 between the facing ribs 45 of the yo-yo halves 10, 12 adjacent the spool between about 0.075" to 0.090", (space 44 being about 0.095" to 0.105") the yo-yo will return easily and controllably even though the string is attached to the freely rotatable spool 46. If the radial ribs 45 are omitted, the yo-yo halves may be placed closer together, bringing space 44 to about 0.075" to 0.090". Thus, the toy, when used as a yo-yo achieves the desired characteristics of long spins and easily controlled return. In its yo-yo configuration, the toy provides superior performance displaying long spinning times yet which is easily retrieved with a simple flick of the wrist. The device is adapted for use by beginners as well as more advanced players. The device is of low cost, simple construction.

Figure 4:
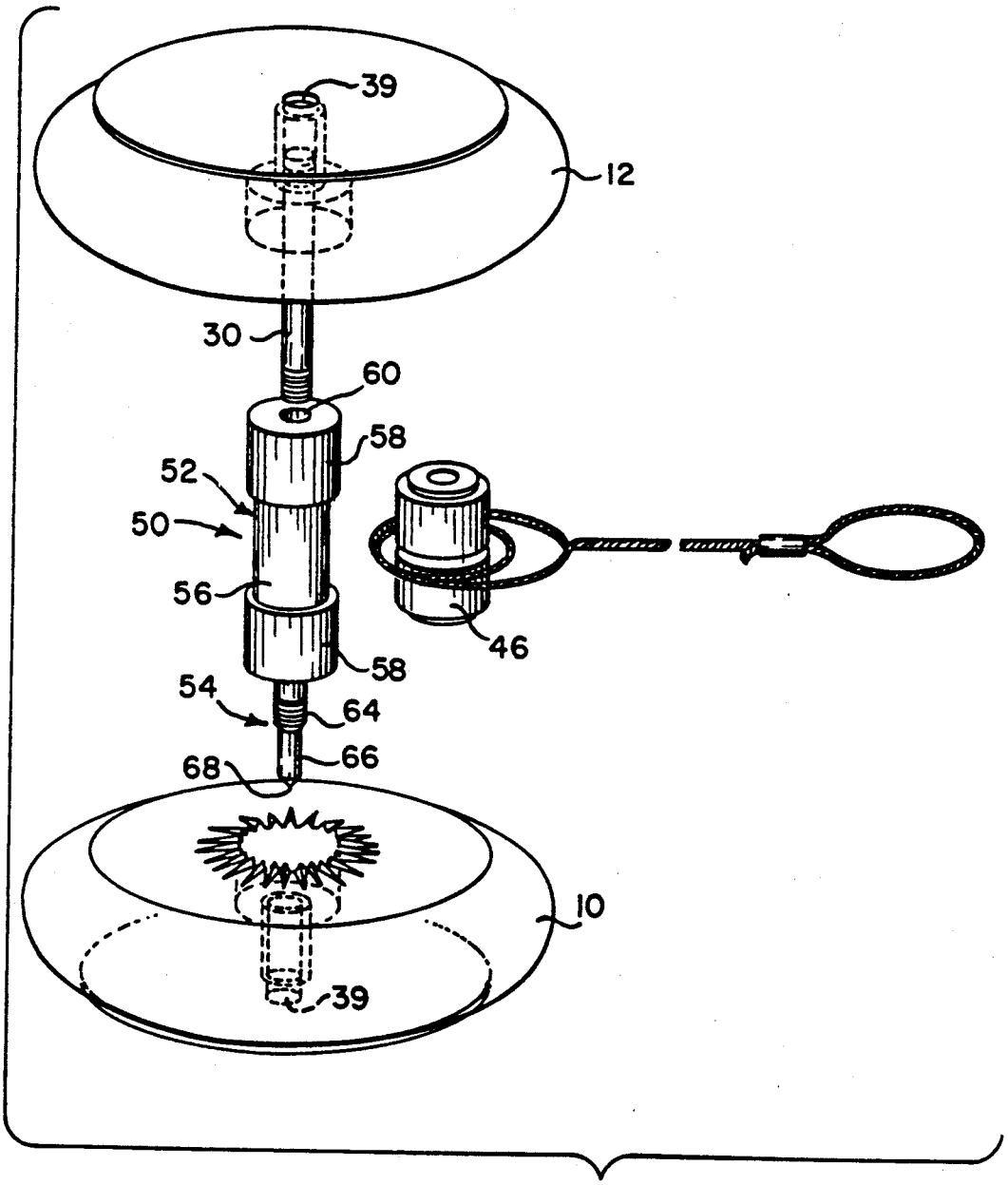
FIG. 4 is an exploded view of the separated first and second yo-yo halves with the top spindle axially aligned and with the connected spool and string detached.
Figure 6:
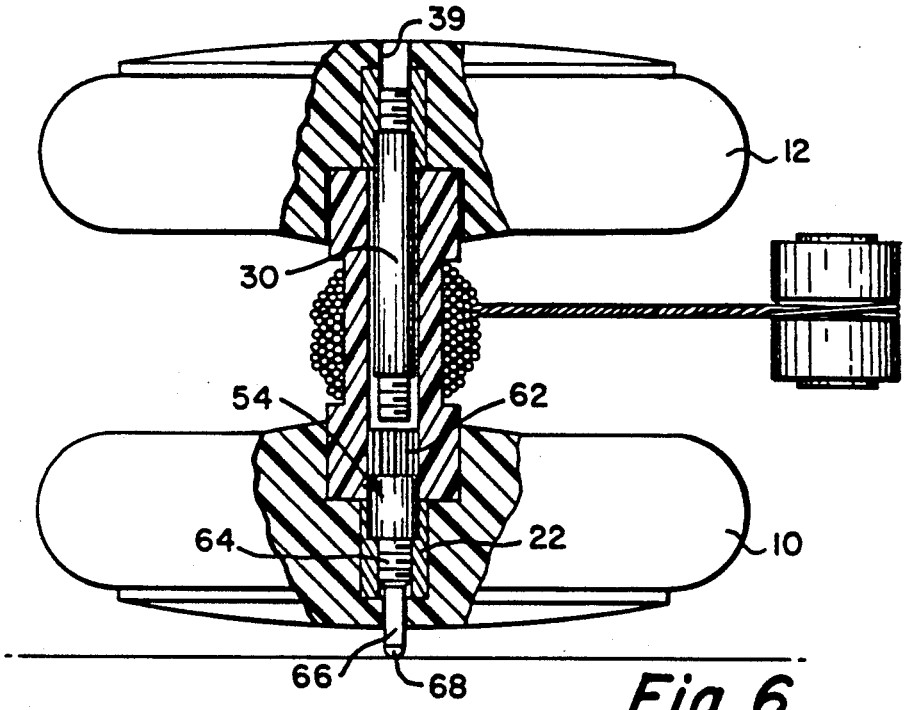
FIG. 6 is a partly sectional illustration of the device in its top configuration with the pull string wrapped about the spindle and the stabilizer in engagement with the spindle in readiness to be launched.
Figure 5:
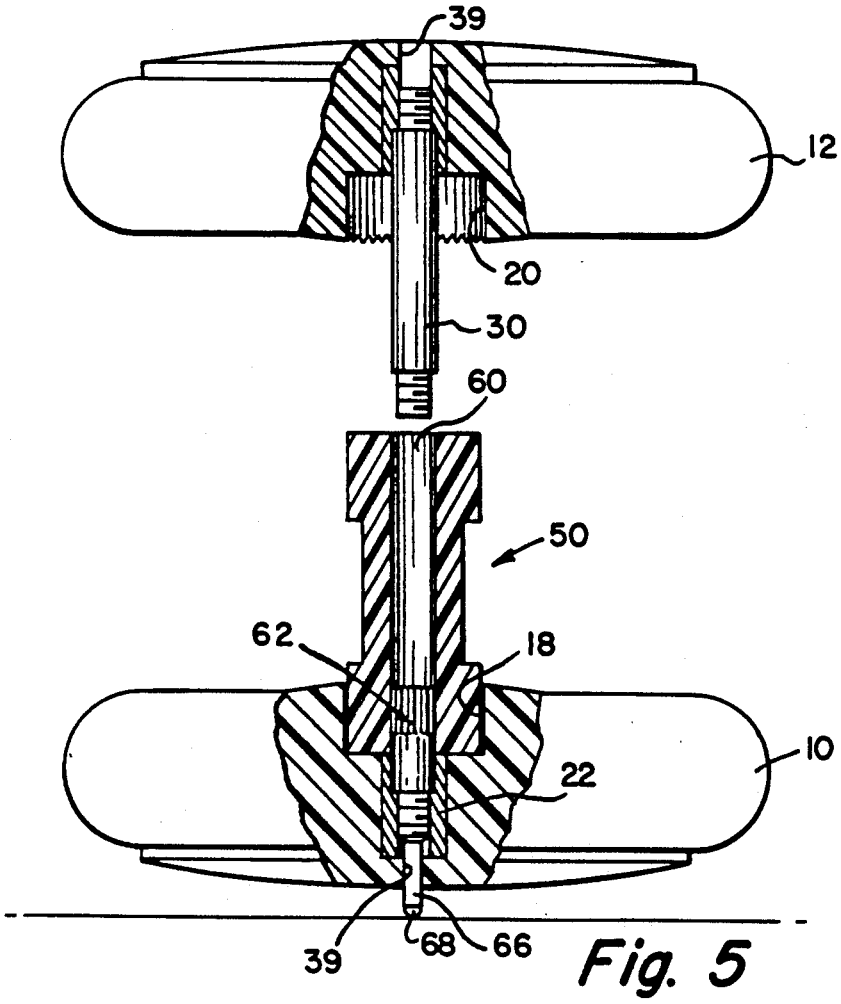
FIG. 5 is a partly sectional illustration of the device in its top configuration with the stabilizing section in readiness to be inserted into the free end of the spindle.

As illustrated in FIGS. 4–6, the yo-yo is quickly and easily converted to a high performance free spinning surface top by the use of a spindle 50. One of the yo-yo halves, such as the first half 10, is unscrewed from the axle. The second yo-yo half and attached axle define a stabilizer, as will be described. The spindle 50 is attached to the separated half 10. In the preferred embodiment, the spindle 50 is formed in two pieces including a plastic drum section 52 and a connector and nib section 54. The nib section 54 is securely attached to and extends axially from one end of the drum section 52. The drum section 52 is cylindrical and may include a central section 56 and a pair of larger diameter end sections 58. Alternately, the central portion 56 of the drum 52 may be of the same diameter as the ends 58, thus defining a constant diameter cylinder. The drum 52 is formed with a central bore 60. The nib section 54 may be attached to the drum section 52 by press fitting the inner end of the nib section 54 into one end of the central bore 60. To facilitate the attachment of the nib section 54 to the drum section 52, the inserted end of the nib may be splined as indicated at 62. The midportion of the nib section 54 is threaded, as indicated at 64 so that it may be screwed into the insert 26 on the separated, first half 10 of the yo-yo. The outermost end of the nib section 54 includes a nib 66 which terminates in a smoothly rounded end 68 adapted to form a smooth rotating bearing surface for the device when in a freely spinning top configuration. The length of the nib 66 is such that when the threads 64 are screwed into the insert 22, the round end 68 of the nib will protrude through the hole 39 in the outer face of the first yo-yo half 10.

The diameter of the end sections 58 of the drum 52 are just slightly less than that of the sockets 18, 20 in the yo-yo halves 10, 12. The axial lengths of the end sections 58 are greater than the axial depths of the sockets 18, 20. The dimensions of the ends 58 and respective sockets 18, 20 are such that the yo-yo/pull string cannot be caught between the drum and the yo-yo halves. The ends 58 of the drum section 52 that is received in the socket 20 of the stabilizing section has sufficient clearance to facilitate free rotation of the end section 58 within the socket 20. Thus, the mating cooperation of the axle 30 and socket 20 of the stabilizing section mates with the socket 60 and end section 58 of the drum 52 to enable the top section to rotate freely with respect to the stabilizing section while the stabilizing section is held to maintain the top section in position.

Thus, in order to convert the yo-yo to use as a top, the first yo-yo half is unscrewed from the axle 30. The spindle 50 is screwed into the first yo-yo half 10 thus to form the top section. The other section, including second yo-yo half 12 and its attached spindle 30 serve as a stabilizer. In order to use the yo-yo, the yo-yo string is wound about the midportion of the drum section 52 as indicated in FIG. 6. The end of the string that is normally attached to the user's finger when the device is used as a yo-yo is the end that is first wrapped about the drum 52. Thus, the spool 46 may serve in this configuration as a handle to facilitate pulling on the string. After the string is wrapped about the drum, the stabilizing section is engaged with the spindle 50 as illustrated in FIG. 6. The device is then placed on a flat surface. It is held in position with one hand gripping the yo-yo half 12 of the stabilizer section while the other hand pulls on the string to accelerate the top. After the string has been pulled away from the drum and the top has accelerated to its maximum speed, the stabilizing section may be withdrawn, thus permitting the top section to spin freely.

Figure 7:
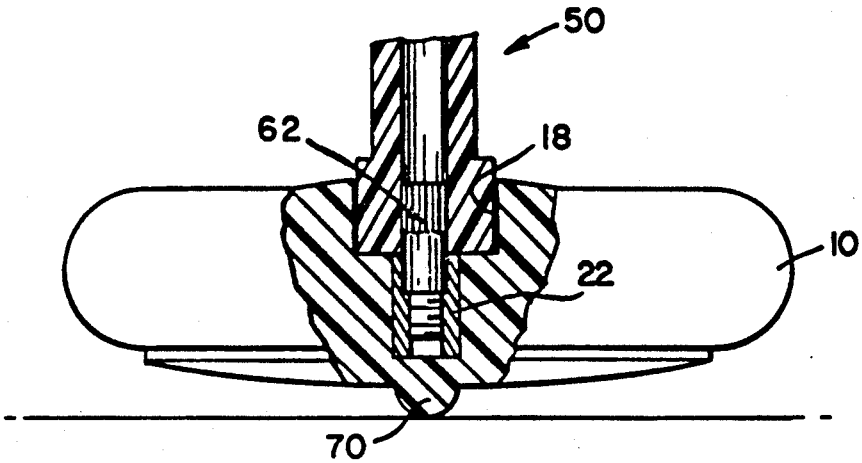
FIG. 7 is a partly sectional illustration of the embodiment wherein the surface contact rib is integrally molded with the yo-yo half.

FIG. 7 illustrates a modified embodiment of the invention which the bearing nib 70 is molded integrally with or otherwise securely attached to the outer surface of the yo-yo half 10. In this embodiment, the yo-yo half 10 does not have a central hole and the spindle 50 does not include a protruding integral nib.

From the foregoing, it will be appreciated that the invention provides a versatile, multi use toy that is easily converted from a yo-yo configuration to a free spinning top. The device is capable of a high degree of performance. It is inexpensive and simple to make and use.

It should be understood, however, that the foregoing description of the invention is intended merely to be illustrative thereof and that other modifications and embodiments may be apparent to those skilled in the art without departing from its spirit.

Having thus described the invention what I desire to claim and secure by Letters Patent is:

1. A yo-yo convertible to a free spinning surface top comprising:

first and second yo-yo halves each having opposite faces;

a yo-yo axle detachably connecting one of the yo-yo halves to the other;

a spindle detachably connectable to a yo-yo half that is detached from the yo-yo axle, the attached spindle extending centrally from one face of the detached yo-yo half and defining a spinnable top section;

means defining a nib at the opposite face of the detached yo-yo half on which the top section can rotate as a free spinning top, the spindle providing a means by which the top section may be spun.

2. A device as defined in claim 1 wherein the spindle has an end and the nib is formed on the end of the spindle; the detached yo-yo half having a central hole formed therethrough, the nib on the end of the spindle protruding through the hole formed in said yo-yo half.

3. A device as defined in claim 1 wherein the nib is integrally attached to at least one of the yo-yo halves.

4. A device as defined in any of claims 1–3 further comprising the spindle being constructed to frictionally engage a pull string.

5. A device as defined in any one of claims 1 or 2 wherein the spindle includes a connector for attachment to the detached yo-yo half and further comprises a nib integral with and extending from the end of the connector, the nib being adapted to extend through the hole in the detached yo-yo half when the spindle is attached to said detached yo-yo half.

6. A device as defined in claim 4 wherein the yo-yo has a string by which the yo-yo axle is supported, said string also comprising the pull string.

7. A device as defined in claim 4 further comprising stabilizing means for rotatably engaging the top section to stabilize the top section during acceleration.

8. A device as defined in claim 6 wherein the rotatably engageable stabilizing means comprises the axle of the yo-yo and a socket in the end of the spindle adapted to receive the free end of the yo-yo axle that is mounted to the other yo-yo half.

9. A device as defined in claim 7 wherein the socket depth is greater than the axial protruding length of the axle.

10. A device as defined in claim 1 wherein the spindle includes a cylindrical drum section adapted to enable a pull string to be wound about its outer surface and means for detachably connecting one end of the drum section to said detached yo-yo half.

11. A device as defined in claim 10 wherein the drum section is formed from a plastic cylinder and having a threaded connector securely attached thereto, the connector being threadable into an insert secured to the detached yo-yo half.

12. A device as defined in claim 2 wherein the spindle further comprises a nib integral with and extending from the end of the connector, the nib being adapted to extend through the hole in the detached yo-yo half when the spindle is attached to said detached yo-yo half.

13. A device as defined in claim 10 wherein at least the end portions of the drum section of the spindle are formed from a relatively low friction plastic.

14. A device as defined in any one of claims 1–3 or 5–12 wherein the spindle further comprises a bore formed axially within the spindle and defining a socket for a stabilizer element.

15. A device as defined in claim 1 wherein the yo-yo further comprises:

a spool rotatably mounted about the axle between the yo-yo halves when the yo-yo halves are connected to the axle, the spool being freely rotatable on the axle and having a limited amount of axial play.

16. A device as defined in claim 15 further comprising a string securely attached to the spool.

17. A device as defined in claims 15 or 16 wherein the spool has ends and a circumferential groove formed about its periphery about midway between the ends of the spool.

18. A method for converting a yo-yo to a free spinning surface top, the yo-yo having a pair of halves connected by an axle and rotatable about a central axis and a string connected to the axle comprising:

detaching one of the halves of the yo-yo from the other half of the yo-yo and from the axle and removing the yo-yo string;

providing one of the yo-yo halves with a separate spindle attached to the central axis of the yo-yo half;

imparting a spin to the spindled half by rotating the spindle with a pull string; and stabilizing the spindled yo-yo half while imparting said spin by supporting one end of the spindle.

* * * * *